US010722905B2

(12) United States Patent
Bentley

(10) Patent No.: US 10,722,905 B2
(45) Date of Patent: Jul. 28, 2020

(54) PAINT ROLLER COVER CLEANER

(71) Applicant: ROLLER BLASTER LIMITED, Feilding (NZ)

(72) Inventor: Stephen Robert Bentley, Feilding (NZ)

(73) Assignee: ROLLER BLASTER LIMITED, Feilding (NZ)

( * ) Notice: Subject to any disclaimer, the term of this patent is extended or adjusted under 35 U.S.C. 154(b) by 158 days.

(21) Appl. No.: 15/576,756

(22) PCT Filed: Jun. 3, 2016

(86) PCT No.: PCT/NZ2016/050093
§ 371 (c)(1),
(2) Date: Nov. 24, 2017

(87) PCT Pub. No.: WO2016/195517
PCT Pub. Date: Dec. 8, 2016

(65) Prior Publication Data

US 2018/0272363 A1 Sep. 27, 2018

(30) Foreign Application Priority Data

Jun. 4, 2015 (NZ) ..... 708805

(51) Int. Cl.
*B05B 1/04* (2006.01)
*B05B 3/18* (2006.01)
*B44D 3/00* (2006.01)

(52) U.S. Cl.
CPC ..... *B05B 1/04* (2013.01); *B05B 3/18* (2013.01); *B44D 3/006* (2013.01)

(58) Field of Classification Search
CPC ..... B05B 1/04
See application file for complete search history.

(56) References Cited

U.S. PATENT DOCUMENTS

| | | | |
|---|---|---|---|
| 2,994,482 | A | 8/1961 | Valois et al. |
| 3,462,300 | A | 8/1969 | Hocutt |
| 3,472,251 | A | 10/1969 | Parker, Jr. |
| 4,294,272 | A | 10/1981 | Klaiber |
| 4,402,333 | A | 9/1983 | Frizzell |
| 5,651,381 | A | 7/1997 | Balouchian |
| 5,935,342 | A | 8/1999 | Boyd |
| 6,363,954 | B2 | 4/2002 | Bastien |

(Continued)

FOREIGN PATENT DOCUMENTS

| | | |
|---|---|---|
| DE | 3528951 A1 | 3/1986 |
| GB | 2291792 | 9/1994 |

(Continued)

*Primary Examiner* — Jason Y Ko
(74) *Attorney, Agent, or Firm* — Thomas Coester Intellectual Property

(57) ABSTRACT

A paint roller cover cleaner including an enclosure for a roller cover, a high pressure pump and a nozzle supplied with pressurised fluid which directs a jet of fluid at the nap of the roller cover to rotate the roller cover and facilitate cleaning. In one embodiment a carriage moves the nozzle along the length of the roller cover to effect cleaning along the length of the roller cover. In another embodiment a plurality of controllable nozzles are provided at intervals along the length of the roller cover. In another embodiment the nozzle includes an inner sleeve and an outer sleeve which relatively rotate to align apertures in the respective sleeves to produce jets sequentially along the nozzle.

20 Claims, 12 Drawing Sheets

(56) References Cited

U.S. PATENT DOCUMENTS

| | | | |
|---|---|---|---|
| 6,408,862 | B1 | 6/2002 | van Rooyen |
| 7,640,941 | B2 | 1/2010 | Watters et al. |
| 7,900,642 | B2 | 3/2011 | Lavender et al. |
| 8,973,592 | B2 | 3/2015 | Suydam |
| 2004/0003835 | A1 | 1/2004 | Higgins |
| 2015/0068561 | A1 | 3/2015 | McClish |

FOREIGN PATENT DOCUMENTS

| | | | |
|---|---|---|---|
| JP | 2003-001198 | A | 1/2003 |
| WO | WO 1993024337 | A1 | 12/1993 |
| WO | WO 2006100469 | A2 | 9/2006 |

PAINT ROLLER COVER CLEANER

FIELD OF THE INVENTION

This invention relates to a paint roller cover cleaner. More particularly, although not exclusively, the invention relates to a paint roller cover cleaner which cleans a paint roller cover (also referred to as a "roller sleeve") using a high pressure jet within an enclosure.

BACKGROUND OF THE INVENTION

The cleaning of paint roller covers manually is slow, messy and ineffective as well as being extremely wasteful of water. Many sites do not have a pressurised water supply and disposal of waste water is often also strictly regulated.

A number of paint roller cover cleaning devices have been proposed. Whilst some are more effective at cleaning paint roller covers than manual cleaning they all tend to be very wasteful of water, typically requiring between 20 to 300 litres of water to effectively clean a roller cover. They typically require a pressurised mains water source, which is often not available at a site to be painted. Mains water supplies whilst sometime referred to as "high pressure" supplies are typically well below 150 psi and so a substantial amount of water is required to properly clean a roller cover. This results in a substantial amount of waste water being produced (typically between 20 and 300 litres) so that it becomes impractical to contain the volume of waste water produced and transport it off site. The large volume of waste water also becomes very expensive to recycle as the coagulant cost is based on water volume. The low pressure of mains water supplies can also make it impractical to properly clean roller covers in some cases. Some devices require the removal of a roller cover from its handle, which is a messy process. Others require manual operation which can affect cleaning performance and is inconvenient.

It is an object of the invention to provide a paint roller cover cleaner that overcomes at least some of these problems or to at least provides the public with a useful choice.

SUMMARY OF THE INVENTION

According to one exemplary embodiment there is provided a paint roller cover cleaner comprising:

a. an enclosure that may be opened to place a roller cover within the enclosure and closed to contain the roller cover within;
b. a high pressure pump capable of producing a fluid supply at a pressure of between 200 to 4000 psi;
c. a nozzle supplied with pressurised fluid from the pump positioned to direct a jet of fluid at the nap of the roller cover to rotate the roller cover and facilitate cleaning; and
d. a carriage that moves the nozzle along the length of the roller cover to effect cleaning along the length of the roller cover.

According to another exemplary embodiment there is provided a paint roller cover cleaner comprising:

a. an enclosure that may be opened to place a roller cover within the enclosure and closed to contain the roller cover within;
b. a clamp which clamps a roller handle to the enclosure so that the roller handle is external to the enclosure and the roller cover is held in a desired position within the enclosure;
c. a high pressure pump;

d. a nozzle supplied with pressurised fluid from the pump positioned to direct a jet of fluid at the nap of the roller cover to rotate the roller cover and facilitate cleaning; and
e. a carriage that moves the nozzle along the length of the roller cover to effect cleaning along the length of the roller cover.

According to another exemplary embodiment there is provided a paint roller cover cleaner comprising:

a. an enclosure that may be opened to place a roller cover within the enclosure and closed to contain the roller cover within;
b. a clamp which clamps a roller handle to the enclosure so that the roller cover is held in a desired position within the enclosure;
c. a fluid supply reservoir within the enclosure supplying fluid to the pump;
d. a high pressure pump;
e. a nozzle supplied with pressurised fluid from the pump positioned to direct a jet of fluid at the nap of the roller cover to rotate the roller cover and facilitate cleaning;
f. a carriage that moves the nozzle along the length of the roller cover to effect cleaning along the length of the roller cover; and
g. a waste fluid reservoir within the enclosure for containing waste fluid produced during cleaning.

There is further provided a paint roller cover cleaner comprising:

a. an enclosure that may be opened to place a roller cover within the enclosure and closed to contain the roller cover within;
b. a high pressure pump capable of producing a fluid supply at a pressure of between 200 to 4000 psi; AND
c. a nozzle supplied with pressurised fluid from the pump positioned to direct a jet of fluid at the nap of the roller cover to rotate the roller cover and facilitate cleaning.

It is acknowledged that the terms "comprise", "comprises" and "comprising" may, under varying jurisdictions, be attributed with either an exclusive or an inclusive meaning. For the purpose of this specification, and unless otherwise noted, these terms are intended to have an inclusive meaning—i.e. they will be taken to mean an inclusion of the listed components which the use directly references, and possibly also of other non-specified components or elements.

Reference to any prior art in this specification does not constitute an admission that such prior art forms part of the common general knowledge.

BRIEF DESCRIPTION OF THE DRAWINGS

The accompanying drawings which are incorporated in and constitute part of the specification, illustrate embodiments of the invention and, together with the general description of the invention given above, and the detailed description of exemplary embodiments given below, serve to explain the principles of the invention.

DETAILED DESCRIPTION OF EMBODIMENTS OF THE INVENTION

The invention generally relates to a paint roller cover cleaner, and in one particular embodiment, to a roller cover cleaner which cleans a paint roller cover using a high pressure jet within an enclosure. The enclosure may allow both supply and waste fluid to be contained within. A nozzle producing a high pressure jet is attached to a carriage which traverses the length of the paint roller cover. A pump supplies the nozzle with high pressure fluid, and it is then positioned to direct a jet of fluid at the nap of the roller cover, causing the roller cover to rotate. The high pressure and induced rotation leaves the roller cover clean and dry, allowing immediate reuse. Waste fluid is drained to an internal or external container for recycling. The high pressure cleaning means that only a small volume of water is used per clean, making transportation within the enclosure and recycling practical.

Figure 1:
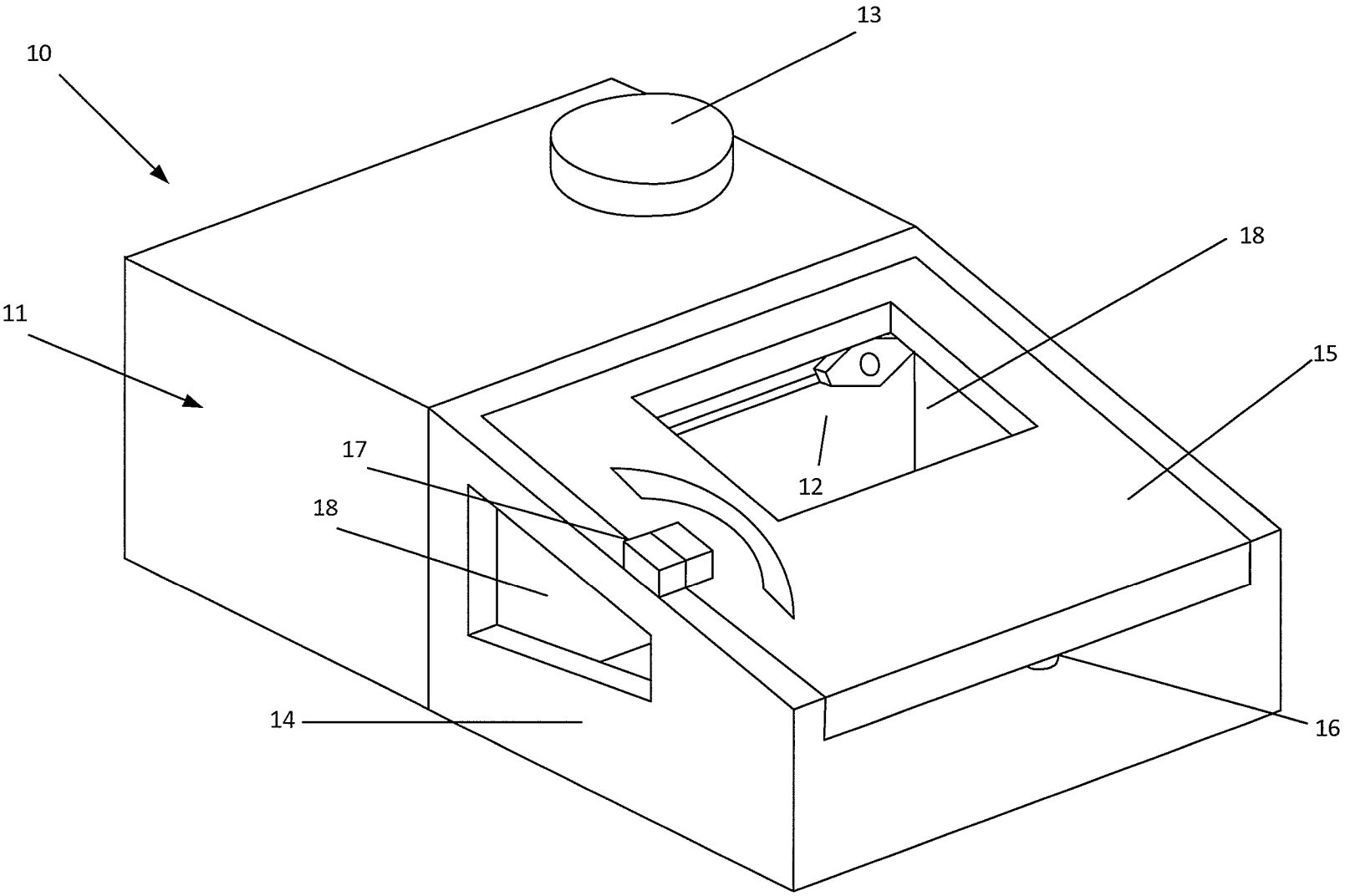
FIG. 1 shows a perspective view of a paint roller cover cleaner according to one embodiment with the lid closed.

A paint roller cover cleaner according to one embodiment 10 is shown with the lid closed in FIG. 1. The back operating region 11 of the enclosure contains reservoirs for both supply and waste fluid, along with a pump and motor to provide water pressure and drive the carriage 12. There is an inlet with a cover 13 for filling the device with the supply fluid, typically water. The front cleaning region 14 of the enclosure receives a paint roller cover to be cleaned. The lid 15 secures the paint roller handle in a groove 16, in the body of the enclosure 14 and is held closed by a latch 17 to ensure all fluid is contained when cleaning is in progress. A transparent viewing panel 18 may be provided to allow observation of the cleaning process.

Figure 2:
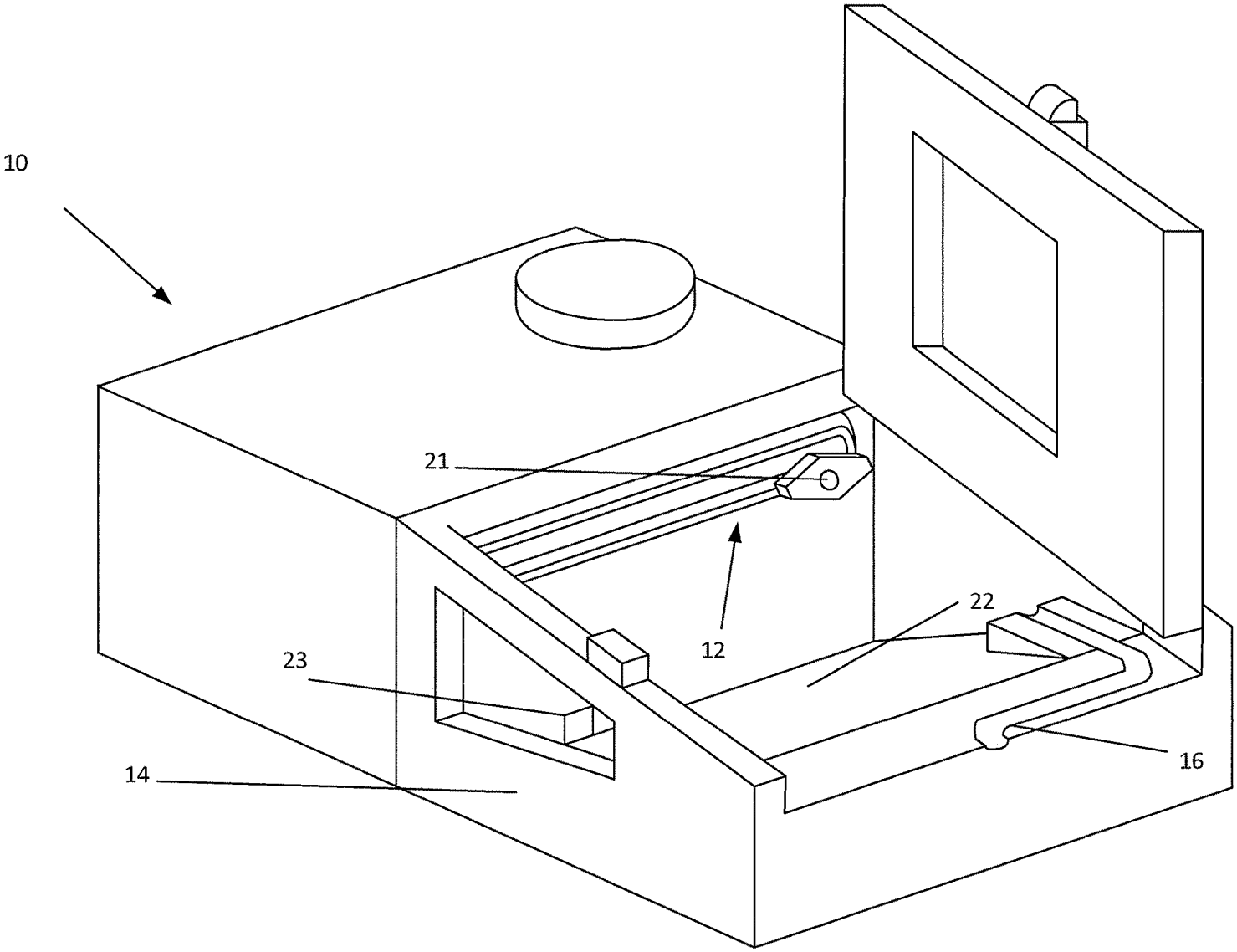
FIG. 2 shows a perspective view of the paint roller cover cleaner as shown in FIG. 1 with the lid open.

FIG. 2 shows the internal configuration when the lid of the enclosure is open. The groove 16 follows the shape of a roller handle for a secure fit and may be designed to fit several different shapes of roller handle. Securely holding the roller cover in place is important for effective cleaning. A cleaning fluid is distributed along the length of the roller cover by a nozzle 21 attached to a sliding carriage 12. The nozzle 21 is supplied with pressurized fluid and positioned to direct a jet of fluid at the nap of the roller cover, causing the roller cover to rotate. The nozzle 21 is preferably directed generally tangentially to the nap to produce rotation. The jet of fluid may be a fan jet that is about 2 cm wide. The fan jet is preferably inclined to the axis of the roller cover so that it can effectively clean the entire nap of the roller cover. Preferably the jet is inclined at an angle of between 5 to 50 degrees with respect to the axis of the roller cover, more preferably about 35 degrees. The angle of inclination of the fan jet to the roller cover could be adjustable to allow a user to set this for the particular type of roller being cleaned. This creates a high pressure jet that provides coverage of the entire nap.

The carriage 12 moves the nozzle along the length of the roller cover to effect cleaning along the length of the roller cover. The base 22 is inclined so that the waste fluid drains to an inlet 23 for a waste fluid reservoir. Due to the high speed rotation of the roller cover, virtually all paint and supplied liquid is expelled. This leaves the roller cover almost completely dry and free from paint residue so that a painter may reuse it immediately without cross contamination of paints.

Figure 3:
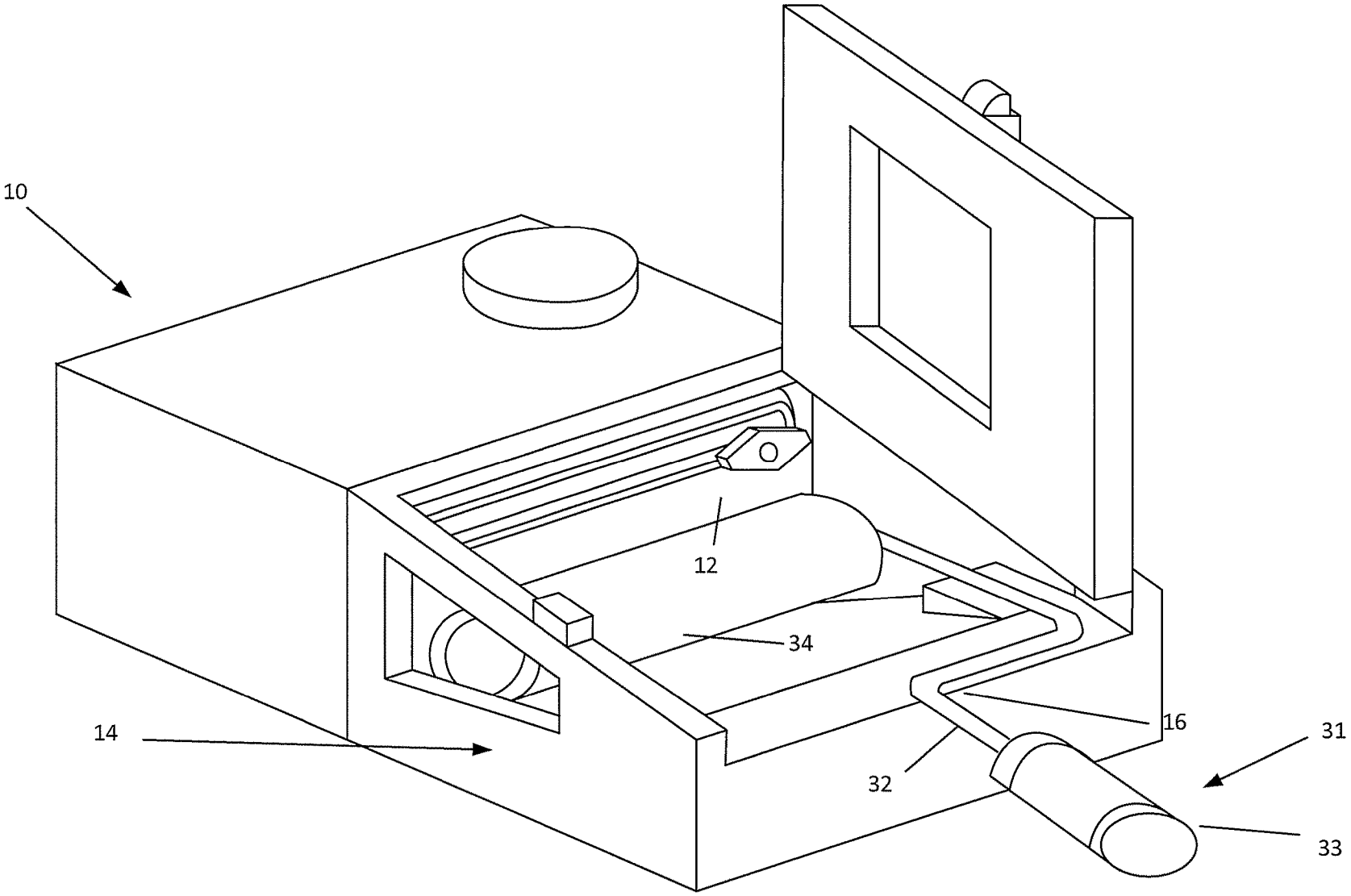
FIG. 3 shows a perspective view of the paint roller cover cleaner as shown in FIG. 1 with the lid open, and a paint roller cover positioned inside.

The position of an example roller cover 31 inside the roller cover cleaner is shown in FIG. 3. The roller handle 32 rests in a groove 16 to hold the roller cover in the desired position, allowing tight clamping to withstand high pressure cleaning. By providing the handle clamp opposite nozzle 21 the roller cover 34 is stabilised against the force of the jet from nozzle 21. At least a portion of the handle 33 that is kept outside the enclosure so that it remains dry. The roller cover 34 may be kept on the handle 32, avoiding the inconvenience of removal. The roller cover 34 is also completely enclosed during cleaning, so that any fluid from the high pressure cleaning is contained. The front section 14 may be adapted to fit roller covers of various widths and diameters and the groove 16 may support roller handles of various shapes.

Figure 4:
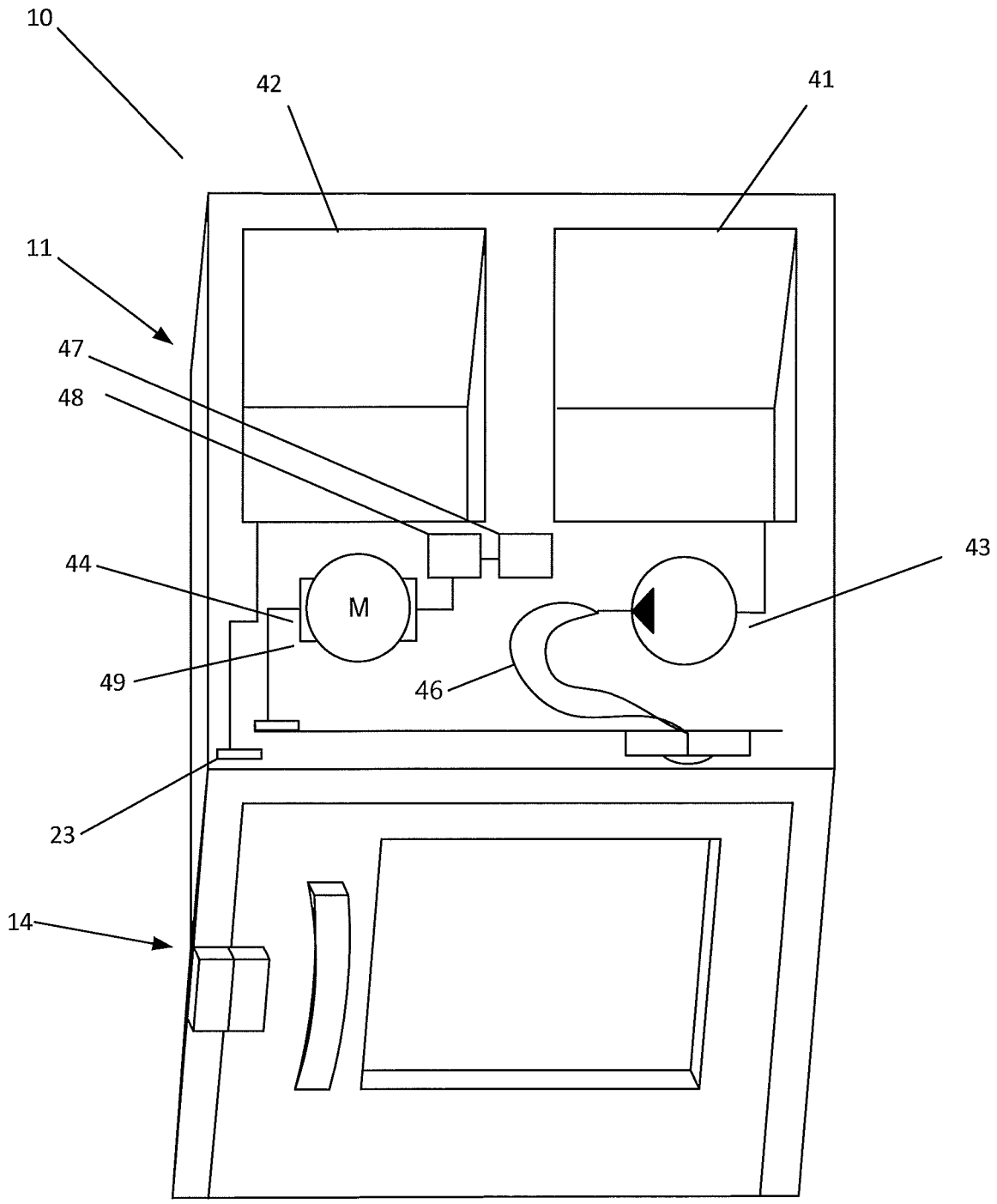
FIG. 4 shows a plan view of the internal components of a paint roller cover cleaner, according to one embodiment.
Figure 5:
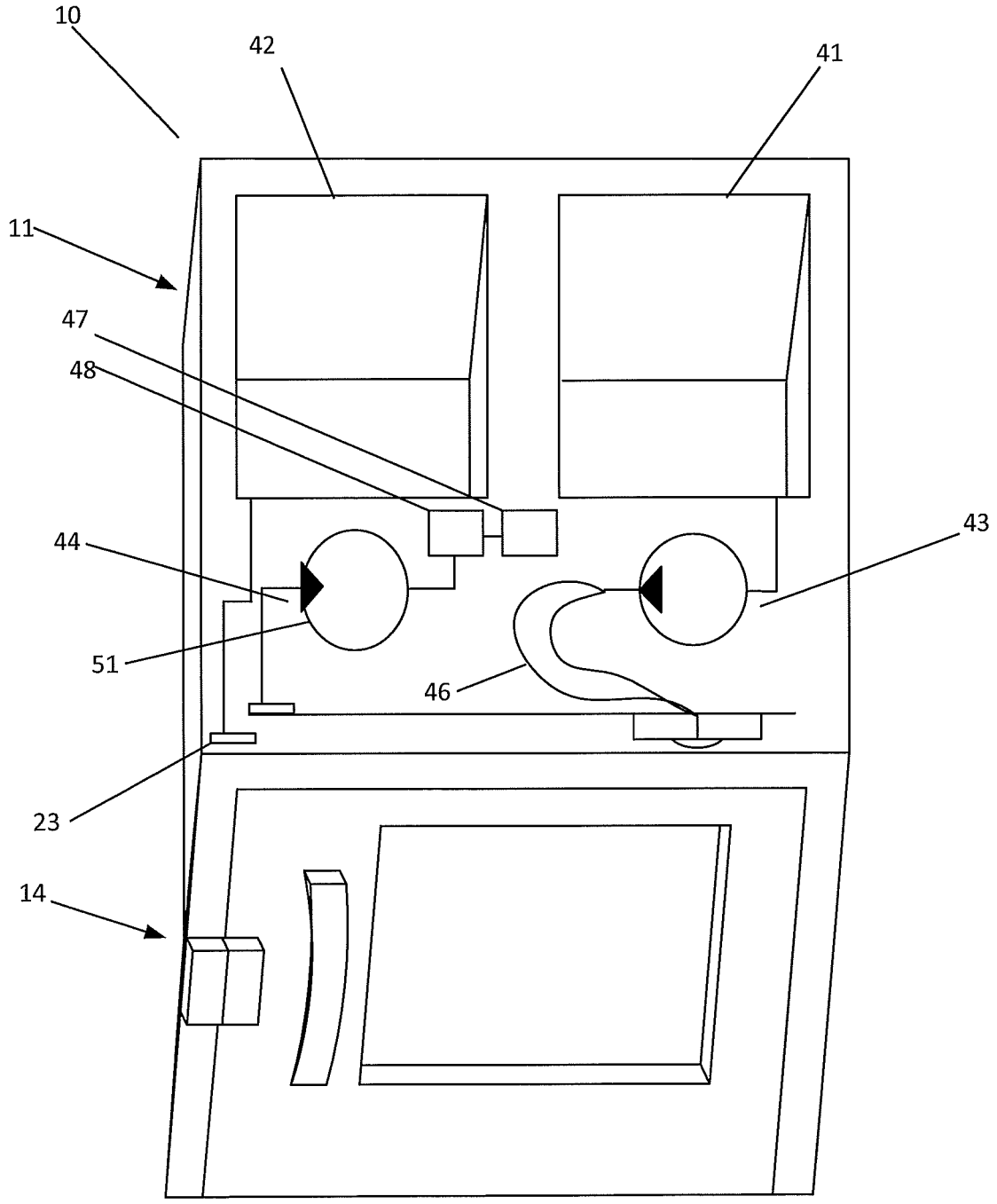
FIG. 5 shows a plan view of the internal components of a paint roller cover cleaner, according to another embodiment.
Figure 6:
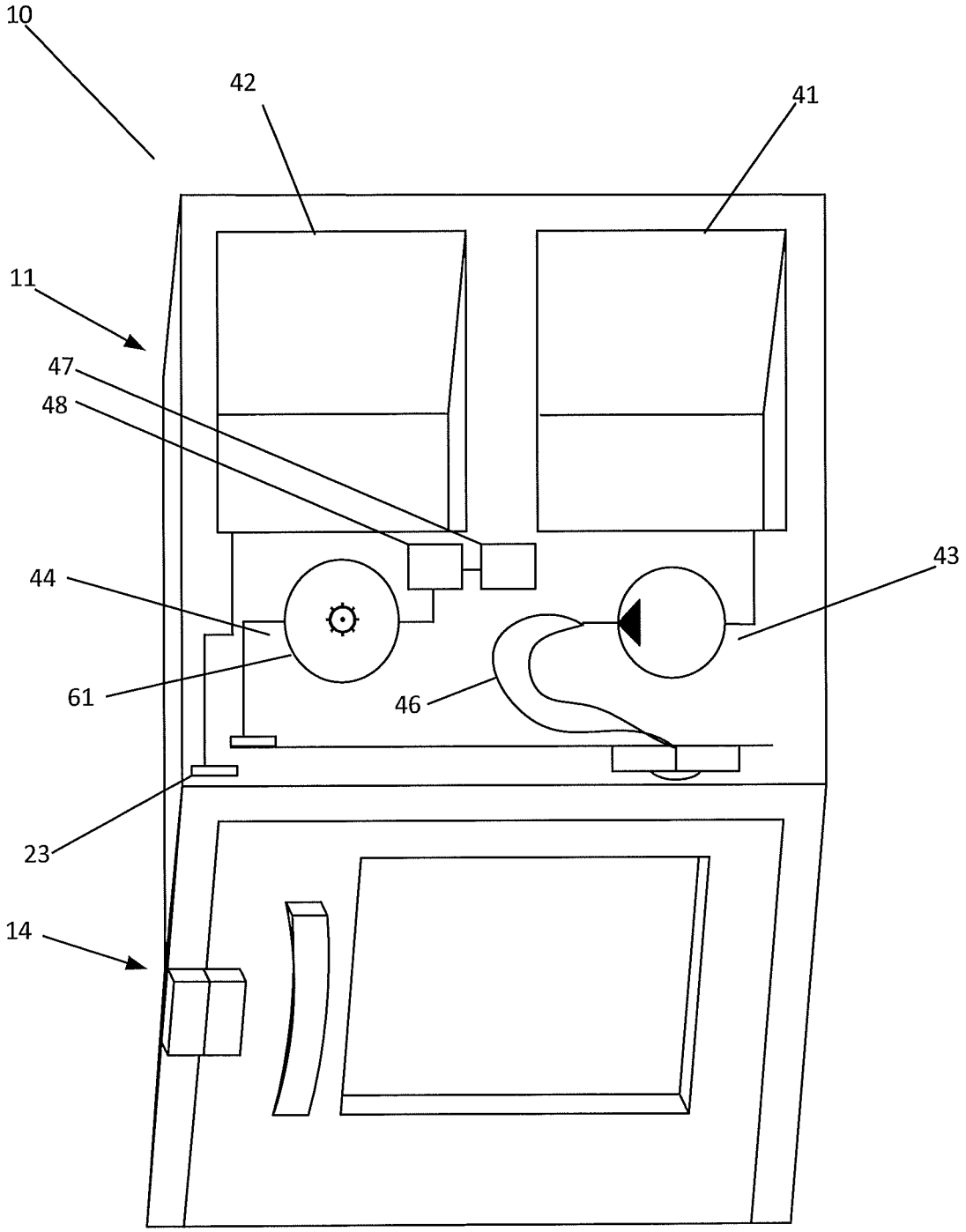
FIG. 6 shows a plan view of the internal components of a paint roller cover cleaner, according to a further embodiment.

FIGS. 4-6 show schematic diagrams of several different possible configurations. All embodiments have a supply fluid reservoir 41, a waste fluid reservoir 42, a high pressure pump 43 and a means of driving the carriage 44. A control system 47 and driver circuit 48 control the operation of the carriage driving means 44. Cleaning fluid is supplied to the high pressure pump 43 from the supply fluid reservoir 41. Waste fluid is drained from the front section 14 to the waste fluid reservoir 42 through an inlet 23 for later recycling, which may be done off site. A pump may be provided to transfer waste fluid from inlet 23 to reservoir 42 if desired. Typically, less than 4 litres of water is used to clean one roller cover, due to the high pressure of the water. This is significantly less than the 20 to 300 litres of previous paint roller cover cleaning devices. The amount of water used makes recycling viable, as it is contained, transportable and a comparatively small volume.

The pump 43 may be internal as shown or externally coupled to the unit. Preferably the pump is self-priming and piston type. For adequate cleaning of the paint roller cover, the pump should produce a fluid supply at a pressure between 200 and 4000 psi. Preferably the pump will produce a fluid supply at a pressure between 500 and 2000 psi. The integrated pump removes reliance on the pressure of tap water or another pressurized water supply for an effective clean.

The means of driving the carriage 44 differ between the embodiments of FIGS. 4-6. FIG. 4 shows an electric motor 49 as the means of driving the carriage via a suitable mechanical drive, such as those employed in printers. Alternatively, a hydraulic motor 51 may be used, as shown in FIG. 5. The hydraulic motor may be connected to the pressurized fluid supply 46. The carriage may also be driven by mechanical means 61, as shown in FIG. 6.

Figure 7:
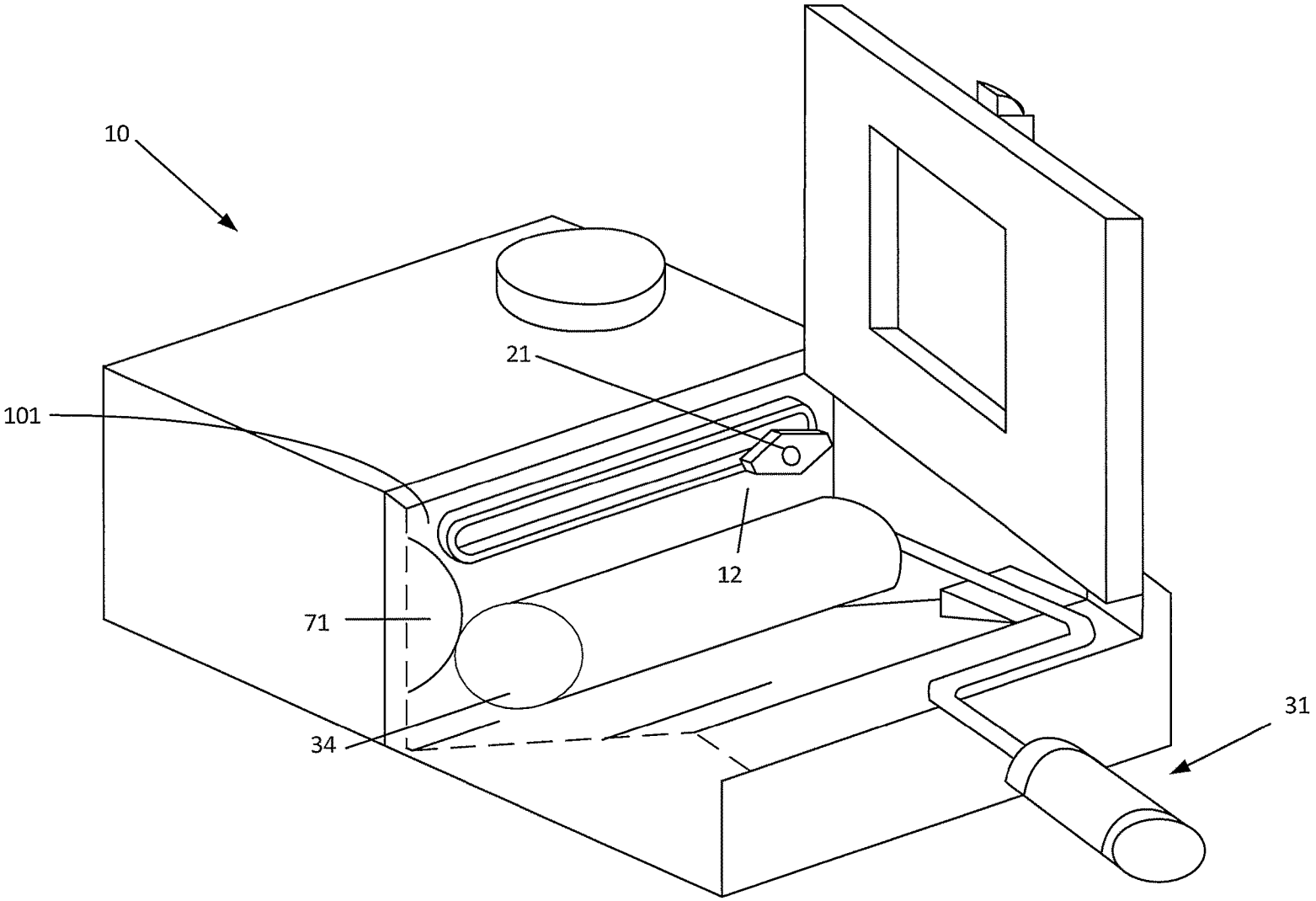
FIG. 7 shows a cutaway view of a paint roller cover cleaner employing a mechanically driven carriage.

A friction drive may be used to utilize the rotation of the roller cover while it is being cleaned to drive the carriage. An example friction drive configuration is shown in FIG. 7. As the high pressure jet 21 rotates the roller cover 34, the rotational motion is transferred to the wheel 71 as they are in contact. The size of the wheel 71 may be chosen to provide an appropriate carriage speed from the transfer of the rotational motion. The friction between the roller cover 34 and the wheel 71 should not inhibit the rotation of the roller cover or shield the end of the roller cover from the movement of the carriage 12, preventing cleaning.

Figure 8:
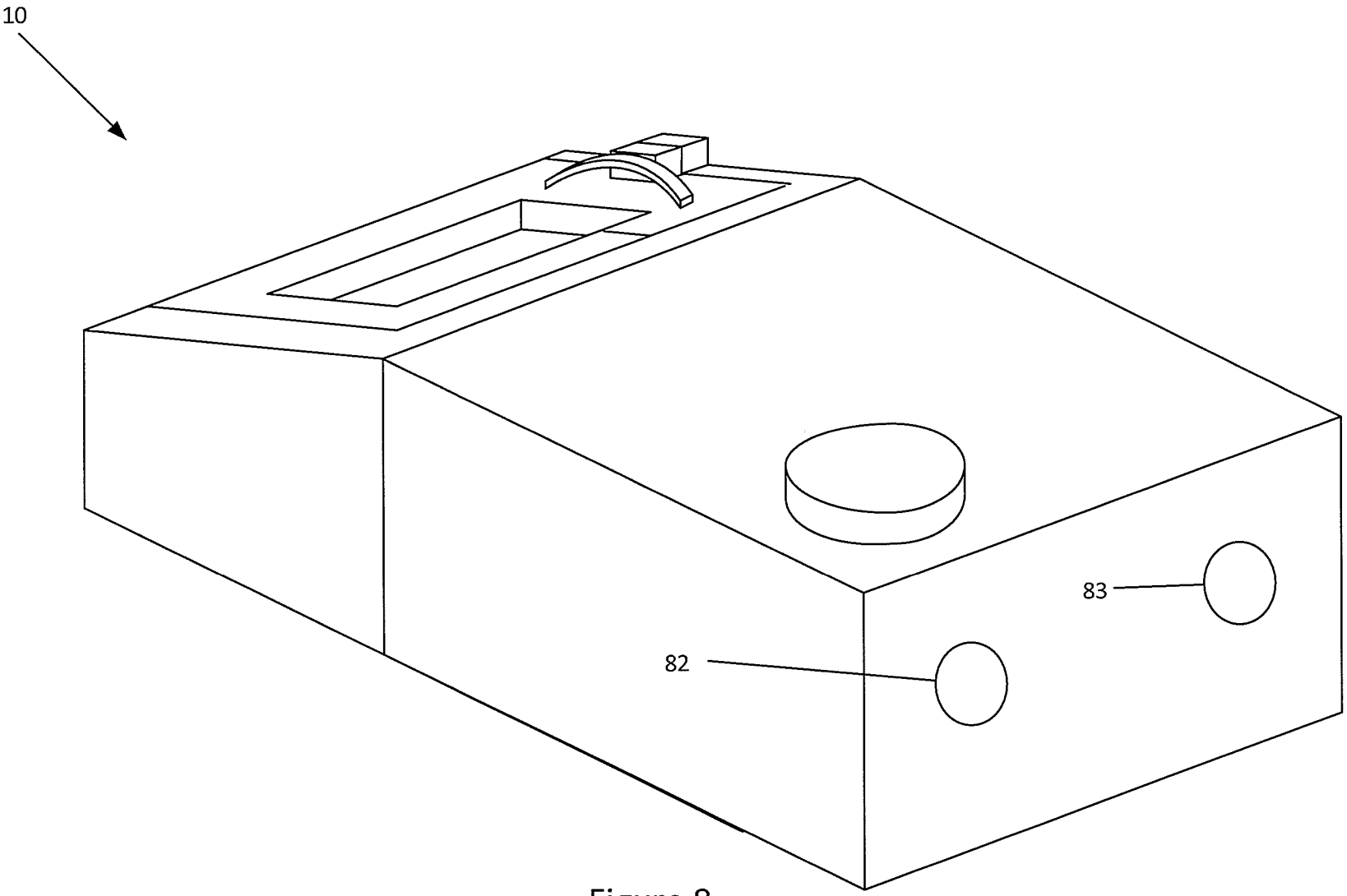
FIG. 8 shows a back view of a paint roller cover, according to an alternative embodiment.

FIG. 8 shows an alternative embodiment where external reservoirs and an external pump may be used. Fluid coupling 81 allows for the attachment of a pressurized external fluid source, whilst coupling 82 supplies waste fluid to an external reservoir. When these fluid couplings are present, the internal reservoirs and pump may still be present, and an appropriate plug may be used to seal the couplings 81 and 82 when not required.

Figure 9:
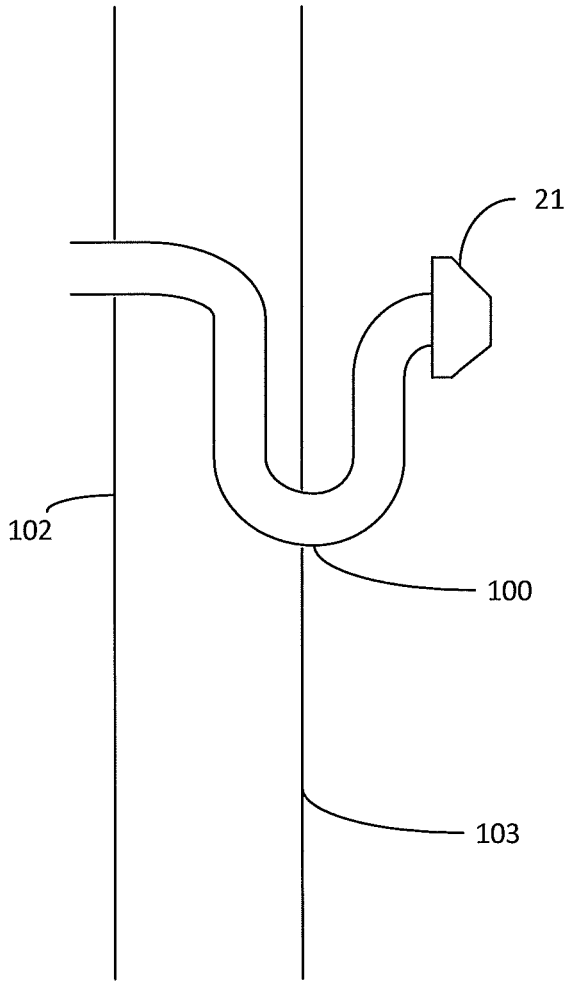
FIG. 9 shows a side view of a fluid supply conduit including a U bend.
Figure 10:
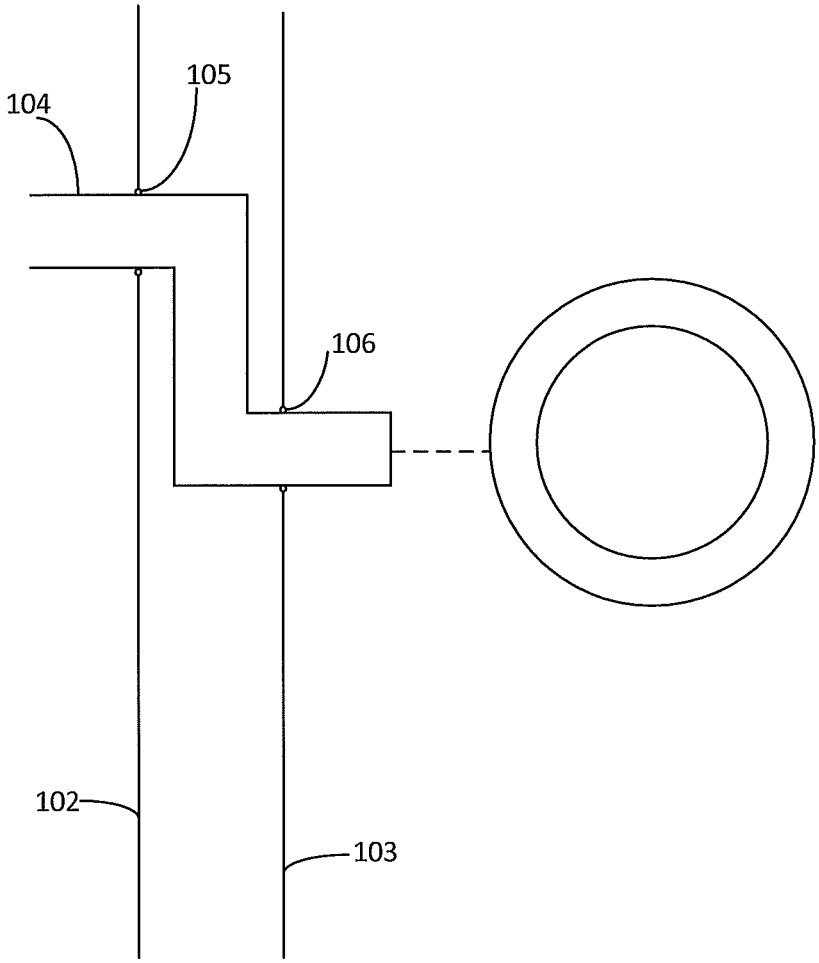
FIG. 10 shows a side view of a barrier having vertically offset apertures for a fluid supply conduit.

FIG. 9 shows a fluid supply conduit 100 for supplying pressurized fluid to nozzle 21 having a U bend to reduce water egress from the cleaning region 14 to the operating region 11 through a barrier 101—in this case in the form of dual walls 102 and 103. FIG. 10 shows another arrangement having spaced apart walls 102 and 103 having vertically offset apertures 105 and 106 for fluid supply conduit 104. In this way any fluid entering aperture 106 drops down in between walls 102 and 103.

Figure 11:
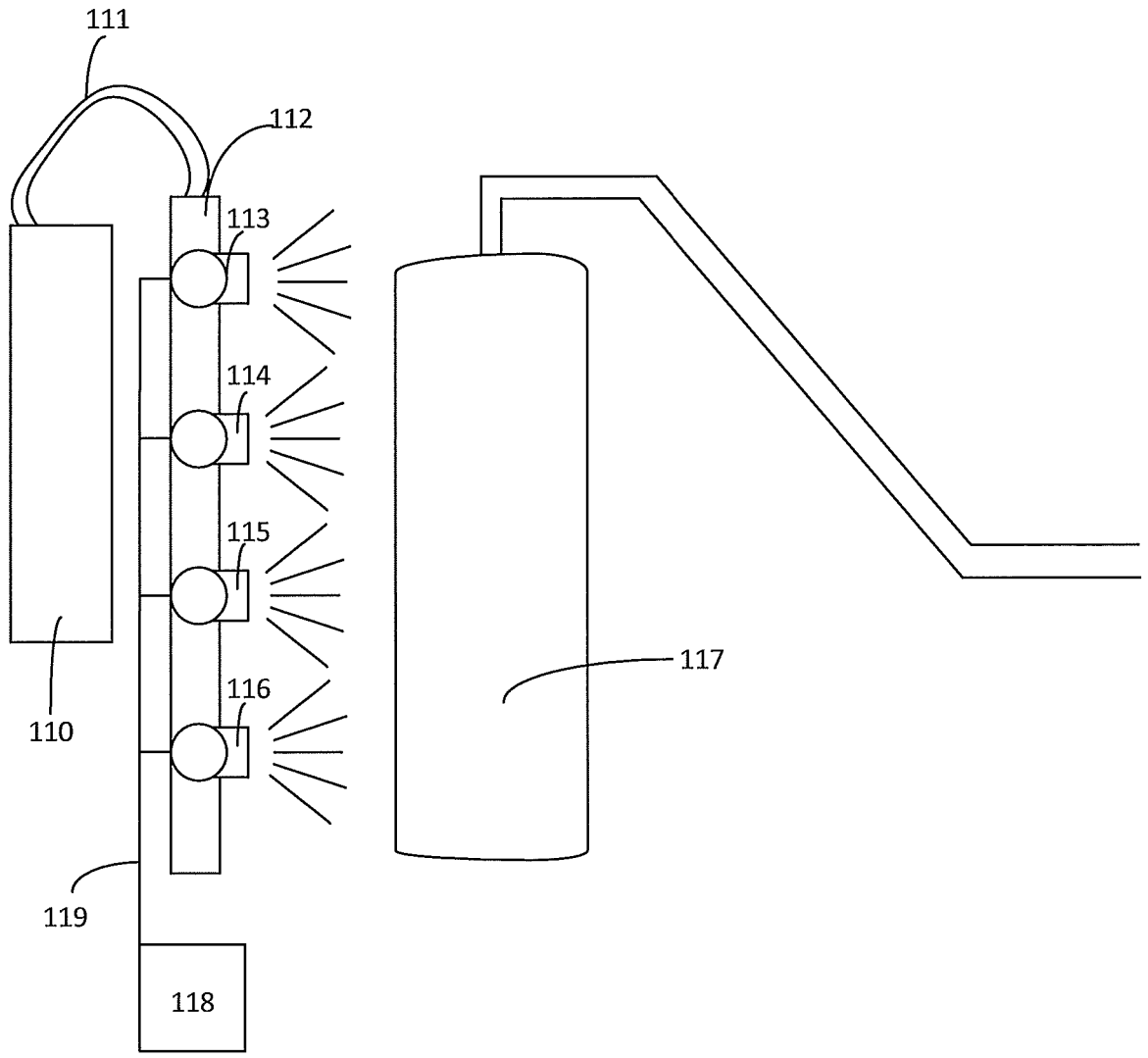
FIG. 11 shows a top view of a paint roller cleaning nozzle arrangement, according to another alternative embodiment.

Referring now to FIG. 11 a schematic view of paint roller cover cleaner shows a high pressure pump supplying pressurized fluid to a manifold 112 via a conduit 111. A plurality of controllable nozzles 113 to 116 receive pressurized fluid from manifold 112. The controllable nozzles may be sequentially activated to sequentially clean sections of roller cover 117. In this case the controllable nozzles include solenoid valves which are sequentially activated via control lines 119 from controller 118. This simplifies the mechanical arrangement but does require multiple controllable nozzles.

Figure 12A:
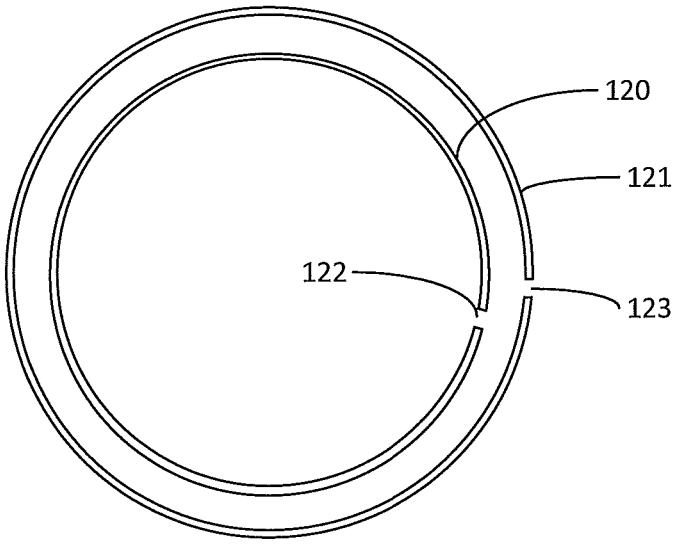
FIG. 12*a* shows a side view of a paint roller cleaning nozzle, according to a further alternative embodiment.
Figure 12B:
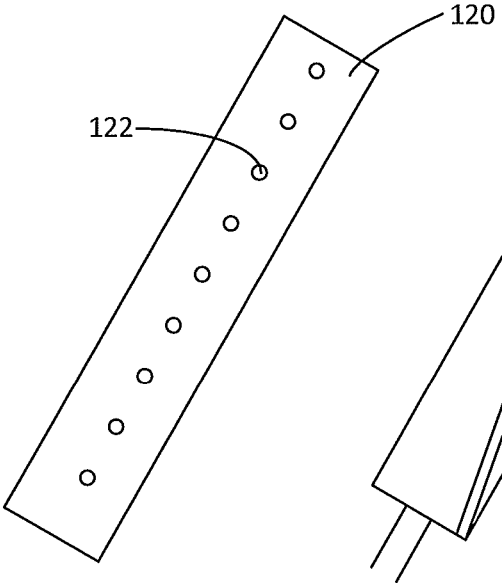
FIG. 12*b* shows a top view of a paint roller cleaning nozzle inner sleeve.
Figure 12C:
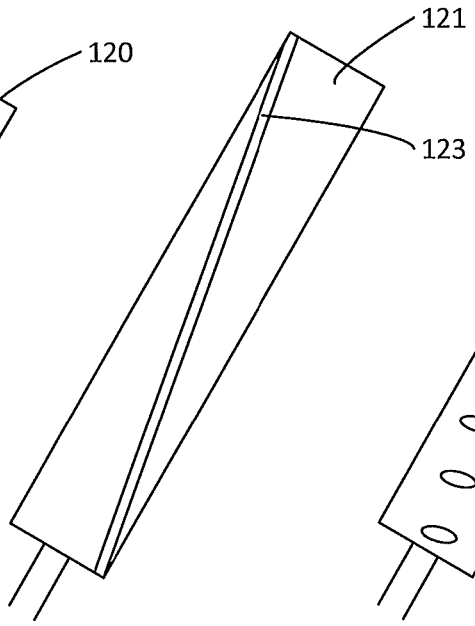
FIG. 12*c* shows a top view of a paint roller cleaning nozzle outer sleeve, according to one embodiment.

FIGS. 12*a* to 12*d* show a further arrangement for producing cleaning jets along the length of a roller cover. FIG. 12*a* shows a side view in which an outer tubular sleeve 121 is rotatably mounted about an inner tubular sleeve 120. As shown in the embodiment shown in plan in FIG. 12*b* the inner sleeve 120 has a plurality of apertures 122 (only one of which is indicated) provided along its length. As shown in the embodiment shown in plan in FIG. 12*c* the outer sleeve 121 has a spiral slot 123 provided along its length. When outer sleeve 121 is rotated about inner sleeve 120 it will be appreciated that apertures 122 will sequentially be aligned with slot 123 so as to sequentially produce a jet from one (or possibly multiple) of the apertures 122. The sleeves are arranged parallel to and spaced apart from a roller cover so that they form a nozzle with sequentially activated jets alone the sleeves progressively cleaning sections of the roller cover as it spins due to the force of the jets.

Figure 12D:
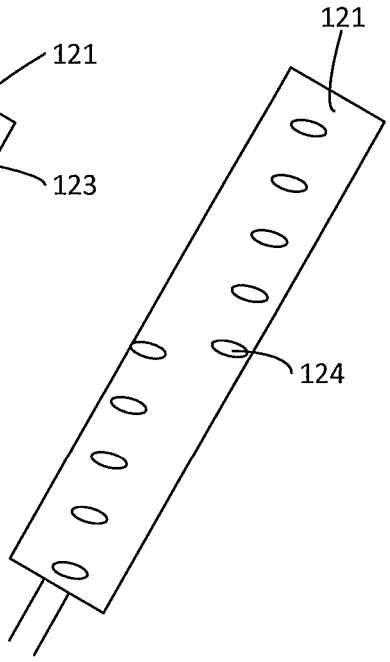
FIG. 12*d* shows a top view of a paint roller cleaning nozzle outer sleeve, according to another embodiment.

It will be appreciated that the arrangement may be reversed and the inner sleeve may be provided with a spiral slot and the outer sleeve with a plurality of spaced apertures. All that is required is a pattern of openings such that when relatively rotated the openings in the sleeves align at different longitudinal positions so as to generate jets at different positions depending on the relative positions of the sleeves. FIG. 12*d* shows a variant in which outer sleeve 121 is provided with a plurality of apertures 124 along a spiral path instead of a single slot. It will be appreciated that this may also be achieved by relative longitudinal movement between the sleeves with appropriately positioned openings.

It will be appreciated that nozzle of any one of the embodiments shown in FIG. 11 and FIGS. 12*a* to *d* may be employed in the paint roller cover cleaner of the type shown in FIGS. 1 to 8 by substitution for the nozzle and sliding carriage arrangement.

There is thus provided a paint roller cover cleaner that may quickly (typically within 30 seconds) and effectively clean a wide range of rollers. The user is not required to remove excess paint from sleeve before cleaning due to the effectiveness of the high pressure jet. No pressured external water supply is required and the device typically uses less than 4 litres of water, compared to 20 to 300 litres for a typical prior art system. This low water use makes recycling a viable option and enables cleaning fluid and waste fluid to be self-contained and easily transportable.

Due to the high pressure jet and high speed of rotation a cleaned roller cover is almost completely dry after cleaning which enables a painter to reuse the roller cover immediately. Due to the highly effective cleaning there is virtually no left over paint residue which eliminates cross contamination should the painter reuse the roller sleeve immediately.

While the present invention has been illustrated by the description of the embodiments thereof, and while the embodiments have been described in detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the applicant's general inventive concept.

The invention claimed is:

1. A portable paint roller cover cleaner to clean a paint roller cover on a paint roller handle, the cleaner comprising:

a. an enclosure that may be opened to place a roller cover within the enclosure and closed to contain the roller cover within;

b. a high pressure pump receiving fluid from a fluid supply and capable of producing a fluid supply at a pressure of between 200 to 4000 psi;

c. a nozzle supplied with pressurized fluid from the pump positioned to direct a jet of fluid at the nap of the roller cover to rotate the roller cover and facilitate cleaning; and d. a carriage that moves the nozzle along the length of the roller cover to effect cleaning along the length of the roller cover; and wherein the enclosure includes a clamp to engage the paint roller handle to maintain the roller cover in a fixed position relative to the carriage.

2. A paint roller cover cleaner as claimed in claim 1 wherein the high pressure pump is capable of producing a fluid supply at a pressure of between 500 to 2000 psi.

3. A paint roller cover cleaner as claimed in claim 1 wherein a fluid supply reservoir is provided within the enclosure.

4. A paint roller cover cleaner as claimed in claim 1 wherein a waste fluid reservoir is provided within the enclosure.

5. A paint roller cover cleaner as claimed in claim 4 wherein the high pressure pump is provided within the enclosure.

6. A paint roller cover cleaner as claimed in claim 1 wherein a jet of fluid produced by the nozzle is directed to impact the nap of a roller cover so as to facilitate cleaning and rotation of the roller cover.

7. A paint roller cover cleaner as claimed in claim 6 wherein the fluid path to the jet includes a U-bend.

8. A paint roller cover cleaner as claimed in claim 6 wherein the jet of fluid is directed generally tangentially towards the nap of the roller cover.

9. A paint roller cover cleaner as claimed in claim 6 wherein the nozzle produces a fan shaped jet.

10. A paint roller cover cleaner as claimed in claim 9 wherein the fan shaped jet that defines a plane, the plane intersecting a longitudinal axis of the roller cover at a substantial angle.

11. A paint roller cover cleaner as claimed in claim 10 wherein the angle is between 5 to 50 degrees with respect the axis of the roller cover.

12. A paint roller cover cleaner as claimed in claim 10 wherein the axis of the jet is offset from the axis of the roller cover by between 14 to 21 mm.

13. A paint roller cover cleaner as claimed in claim 9 wherein the fan shaped jet is about 2 cm wide where it impacts a roller cover in use.

14. A paint roller cover cleaner as claimed in claim 1 wherein the carriage reciprocates parallel to the roller cover axis.

15. A paint roller cover cleaner as claimed in claim 1 wherein at least part of the roller handle is external to the enclosure when it is clamped in place.

16. A paint roller cover cleaner as claimed in claim 1 wherein the clamp is provided opposite the nozzle.

17. A paint roller cover cleaner as claimed in claim 1 wherein the enclosure is divided into a cleaning region and an operating region with a barrier provided between the cleaning region and the operating region to restrict the ingress of fluid into the operating region.

18. A paint roller cover cleaner to clean a paint roller cover on a paint roller handle, the cleaner comprising:

a. an enclosure that may be opened to place a roller cover within the enclosure and closed to contain the roller cover within;

b. a clamp which clamps a roller handle to the enclosure so that the roller cover is held in a desired position within the enclosure;

c. high pressure pump;

d. a nozzle supplied with pressurized fluid from the pump configured to produce a fan shaped jet that defines a plane, the plane intersecting a longitudinal axis of the roller cover at a substantial angle and positioned to direct a jet of fluid at the nap of the roller cover to rotate the roller cover and facilitate cleaning; and e. a carriage that moves the nozzle along the length of the roller cover to effect cleaning along the length of the roller cover.

19. A paint roller cover cleaner to clean a paint roller cover on a paint roller handle, the cleaner comprising:

a. an enclosure that may be opened to place a roller cover within the enclosure and closed to contain the roller cover within;

b. a high pressure pump capable of producing a fluid supply at a pressure of between 200 to 4000 psi; and c. a nozzle supplied with pressurized fluid from the pump configured to produce a fan shaped jet that defines a plane, the plane intersecting a longitudinal axis of the roller cover at a substantial angle and positioned to direct a jet of fluid at the nap of the roller cover to rotate the roller cover and facilitate cleaning; and d. a carriage that moves the nozzle along the length of the roller cover to effect cleaning along the length of the roller cover.

20. A paint roller cover cleaner as claimed in claim 18 wherein the axis of the jet is offset from the axis of the roller cover by between 14 to 21 mm.

* * * * *